US006782587B2

(12) United States Patent
Reilly

(10) Patent No.: US 6,782,587 B2
(45) Date of Patent: Aug. 31, 2004

(54) SEAT BELT ADJUSTER CLIP

(76) Inventor: William Reilly, 708 Peter Robertson Blvd., Brampton, Ontario (CA), L6R 1L6

( * ) Notice: Subject to any disclaimer, the term of this patent is extended or adjusted under 35 U.S.C. 154(b) by 0 days.

(21) Appl. No.: 10/369,925

(22) Filed: Feb. 18, 2003

(65) Prior Publication Data

US 2003/0172500 A1 Sep. 18, 2003

Related U.S. Application Data

(60) Provisional application No. 60/364,390, filed on Mar. 15, 2002.

(51) Int. Cl.[7] ..... B60R 22/10
(52) U.S. Cl. ..... 24/198; 297/483
(58) Field of Search ..... 24/198–200, 163 R, 24/315; 297/468, 483; 280/808

(56) References Cited

U.S. PATENT DOCUMENTS

| | | | | | |
|---|---|---|---|---|---|
| 2,551,019 | A | * | 5/1951 | La Pierre | 24/543 |
| 5,154,446 | A | | 10/1992 | Blake | 280/808 |
| 5,201,099 | A | | 4/1993 | Campbell | 24/198 |
| 5,410,780 | A | | 5/1995 | Silagy | 24/168 |
| D360,168 | S | | 7/1995 | Kelleghan | D11/216 |
| D374,327 | S | | 10/1996 | Marguerie | D2/639 |
| D381,891 | S | | 8/1997 | Anscher | D8/383 |
| 5,706,560 | A | * | 1/1998 | Anscher et al. | 24/543 |
| D408,961 | S | | 5/1999 | Myers | D2/639 |
| 5,947,177 | A | * | 9/1999 | Kratzer | 160/178.1 V |
| 6,092,265 | A | | 7/2000 | Sesay | 24/200 |
| D439,026 | S | | 3/2001 | Reilly | D2/639 |
| 2001/0033102 | A1 | | 10/2001 | Conaway | 297/483 |

FOREIGN PATENT DOCUMENTS

EP 1048535 A2 * 11/2000 ..... B60R/22/10

* cited by examiner

*Primary Examiner*—James R. Brittain
(74) *Attorney, Agent, or Firm*—Carter Schnedler & Monteith, P.A.

(57) ABSTRACT

A shoulder strap repositioner for use in combination with a vehicle seat belt assembly having a lap belt and a diagonally-extending shoulder strap. The repositioner is generally "S" shaped in cross section and includes a generally flat panel-like intermediate portion, a generally flat panel-like upwardly extending rear tongue attached at the bottom by a lower connecting web to the intermediate portion so as to define a space for the lap belt, and a generally flat panel-like downwardly extending front tongue attached at the top by an upper connecting web to the intermediate portion so as to define a space for the shoulder strap. So that the repositioner releases itself in the event of a collision, either the downwardly extending front tongue has an upper weakened portion in the form of a notch extending laterally across near the upper connecting web, or the upwardly extending rear tongue has a lower weakened portion in the form of a notch extending laterally across near the lower connecting web, or both. To aid in retention of the repositioner to the lap belt, there is a fastening device at the upper end of the space for the lap belt. The fastening device includes an element on the upwardly extending rear tongue and a mating element on the intermediate portion.

14 Claims, 4 Drawing Sheets

SEAT BELT ADJUSTER CLIP

CROSS-REFERENCE TO PROVISIONAL APPLICATION

The benefit of U.S. Provisional Patent Application Ser. No. 60/364,390, filed Mar. 15, 2002 is claimed.

BACKGROUND OF THE INVENTION

The invention relates generally to vehicle seat belt assemblies of the type having a lap belt and a diagonally-extending shoulder strap. The invention more particularly relates to shoulder strap repositioners, which may also be referred to as "adjusters," for repositioning or deflecting the diagonally-extending shoulder strap component of vehicle seat belt assemblies.

This invention is an improvement to the Seat Belt Clip disclosed in my U.S. Design Pat. No. D439,026, issued Mar. 20, 2001. This invention also improves the adjustment device of Blake U.S. Pat. No. 5,154,446.

Conventional seat belt assemblies, which include a lap belt and a diagonally-extending shoulder strap, are designed primarily for use by adults of average size. When used by an adult, the shoulder strap extends generally across the chest and shoulder of the individual.

However, when the seat belt assembly is used by a child or smaller adult, the shoulder strap typically extends across the neck or face of the child because his or her upper body is not quite as long as that of a taller individual.

SUMMARY OF THE INVENTION

A shoulder strap repositioner embodying the invention is for use in combination with a vehicle seatbelt assembly having a lap belt and a diagonally-extending shoulder strap. The repositioner has a top, a bottom, a front and a rear, and is generally "S" shaped in cross section. The repositioner includes a generally flat panel-like intermediate portion, a generally flat panel-like upwardly extending tongue at the rear of the repositioner, and a generally flat panel-like downwardly extending tongue at the front of the repositioner. The upwardly extending rear tongue is attached at the repositioner bottom to the intermediate portion by a lower connecting web, thereby defining a space for the lap belt between the upwardly extending tongue and the intermediate portion. The downwardly extending front tongue is attached at the repositioner top to the intermediate portion by an upper connecting web, thereby defining a space for the shoulder strap between the downwardly extending tongue and the intermediate portion.

In some embodiments, so that the repositioner releases itself in the event of a collision, either the downwardly extending tongue has an upper weakened portion extending laterally across the downwardly extending tongue near the upper connecting web, or the upwardly extending tongue has a lower weakened portion extending laterally across the upwardly extending tongue near the lower connecting web, or both.

To aid in retention of the repositioner to the lap belt, repositioners embodying the invention may include a fastening device at the upper end of the space for the lap belt. The fastening device includes an element on the upwardly extending tongue and a mating element on the intermediate portion.

DETAILED DESCRIPTION

Figure 1:
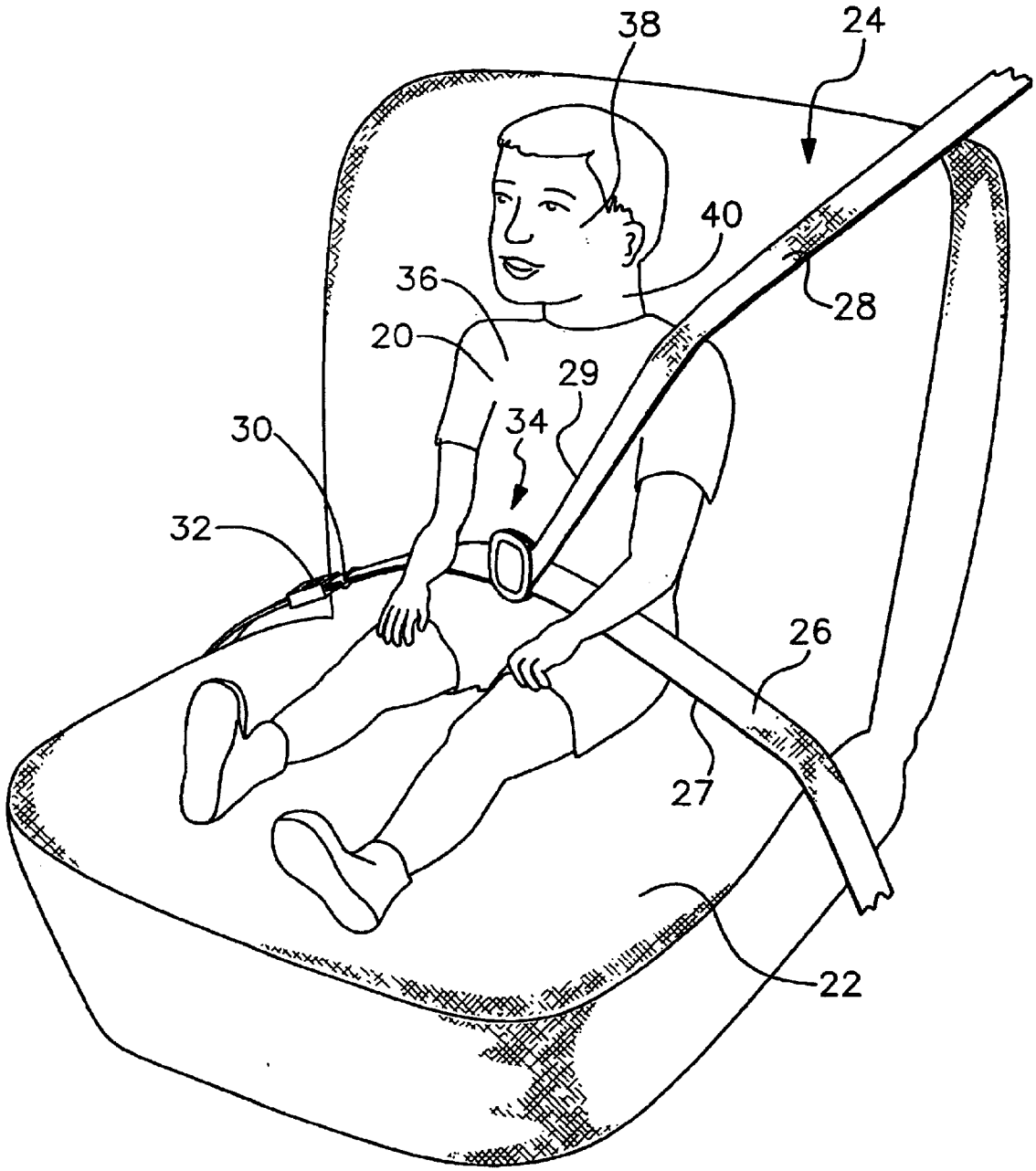
FIG. 1 depicts a shoulder strap repositioner embodying the invention in use.

Referring first to FIG. 1, a child 20 or an adult of short stature is seated in a vehicle seat 22 equipped with a conventional seat belt assembly, generally designated 24. The seat belt assembly 24 includes a lap belt 26 having a lower edge 27, and a diagonally-extending shoulder strap 28 having an upper edge 29 and attached to one element 30 of a buckle device 32. A shoulder strap repositioner 34 embodying the invention is positioned against the torso 36 of the child 20, or other seated person. In the absence of deflection provided by the repositioner 34, the shoulder strap 28 undesirably would tend to cross the face 38 or neck 40 of the child 20.

Figure 2:
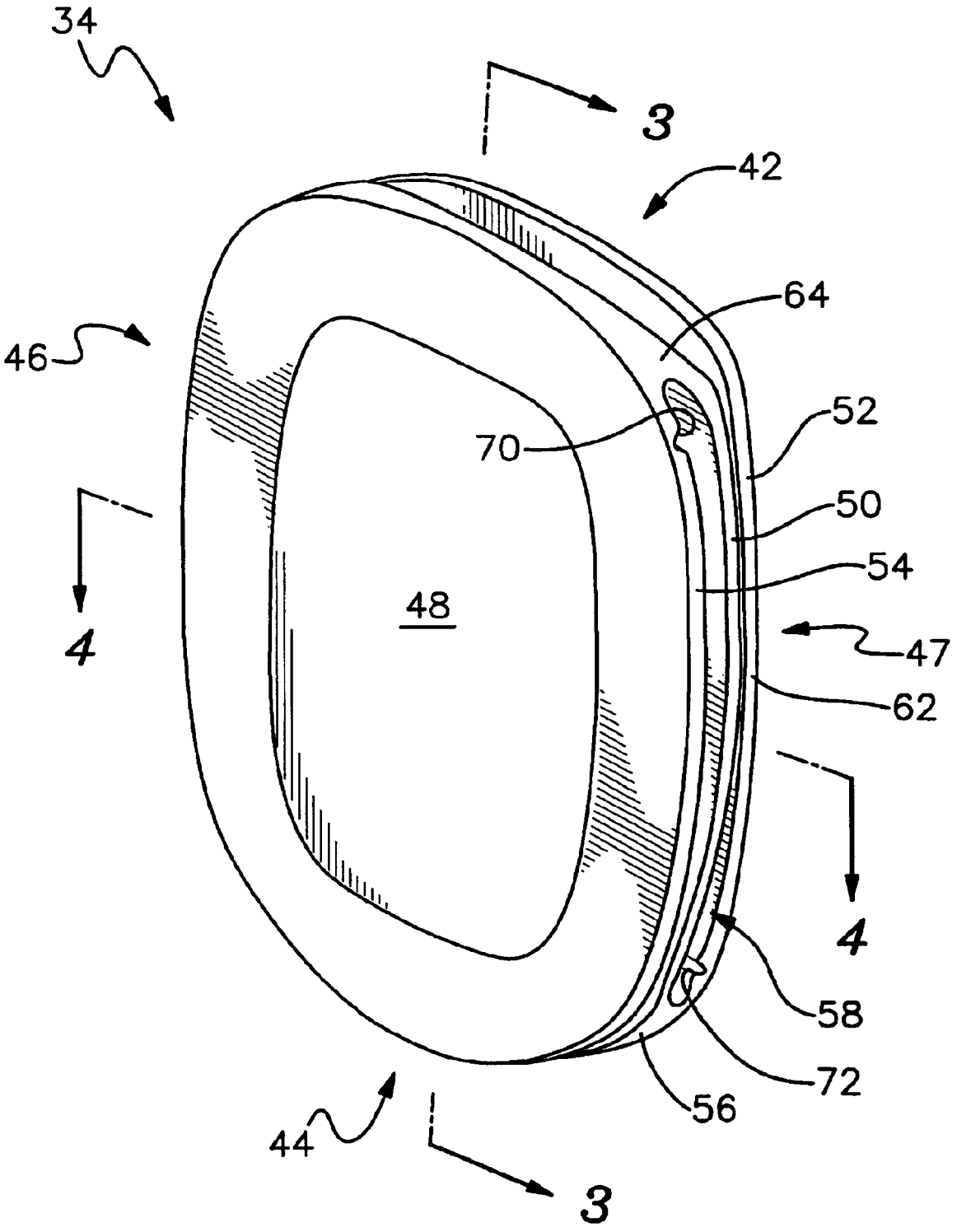
FIG. 2 is a three dimensional view thereof in isolation and in generally the same orientation as in FIG. 1.
Figure 3:
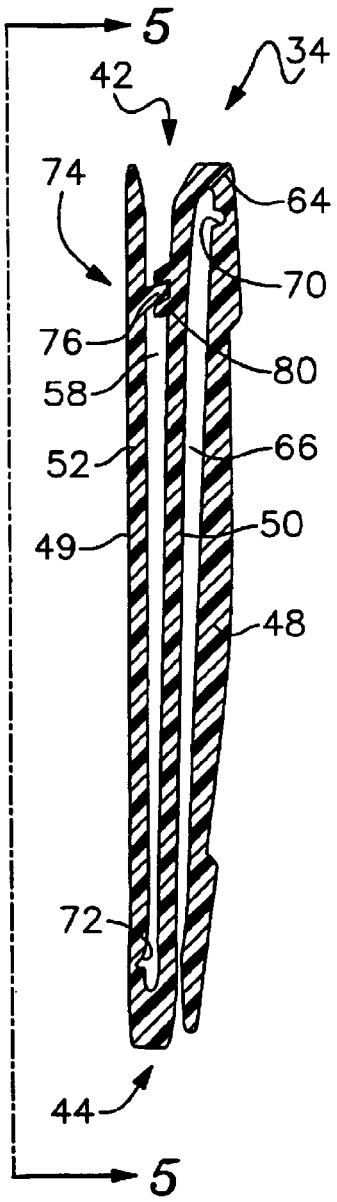
FIG. 3 is a cross-sectional view taken on line 3—3 of FIG. 2.
Figure 4:
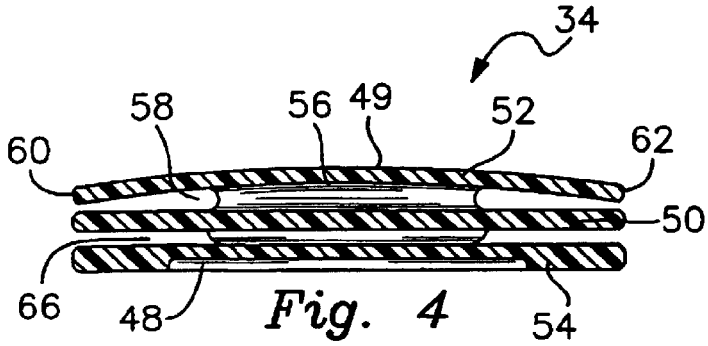
FIG. 4 is a cross-sectional view taken on line 4—4 of FIG. 3.

With reference to FIGS. 2, 3 and 4, the repositioner 34 is relatively flat, and is molded in one piece out of plastic. In its in-use position, the repositioner 34 has a top 42, a bottom 44, a left side 46 and a right side 47. During use, a front 48 is visible, and a rear 49, against the torso 36, is hidden.

The repositioner 34 is generally "S" shaped in cross section, although the "S" is squashed from top to bottom, and oriented on its side during use, as in the orientation of FIG. 3.

The repositioner 34 includes a generally flat panel-like intermediate portion 50, a generally flat panel-like upwardly extending tongue 52 which is against the torso 36 during use, and a generally flat panel-like downwardly extending tongue 54 which is visible during use. The upwardly extending tongue 52 may also be referred to as the rear tongue 52, and the downwardly extending tongue 54 may also be referred to as the front tongue 54. The intermediate portion 50, the upwardly extending tongue 52 and the downwardly extending tongue 54 are generally rectangular, but with rounded corners, when viewed from the front, and are generally parallel to each other.

At the bottom 44 of the repositioner 34, the upwardly extending (rear) tongue 52 is attached at its lower end to the intermediate portion 50 by a lower connecting web 56. Between the intermediate portion 50 and the upwardly extending tongue 52 a space 58 is defined for the lap belt 26 during use. The space 58 may be defined either by the shape of the repositioner 34 as manufactured, or by deflection upon actual insertion of the lap belt 26. During use, the lower edge 27 of the lap belt 26 bears against the lower connecting web 56.

As illustrated in FIG. 4, to minimize slippage of the repositioner 34 along with the lap belt 26 during use, the upwardly extending (rear) tongue 52 has a convex curvature when viewed from the rear 49 such that side edges 60 and 62 of the upwardly extending tongue 52 nearly contact the intermediate portion 50, and do contact the lap belt 26 when installed. As a result, the lap belt 26 is frictionally engaged.

The upwardly extending tongue 52 is made of resilient plastic, and accordingly deflects and functions as a spring.

At the top 42 of the repositioner 34, the downwardly extending (front) tongue 54 likewise is attached at its upper end to the intermediate portion 50 by an upper connecting web 64. A space 66 for the shoulder strap 28 is defined between the intermediate portion 50 and the downwardly extending tongue 54. The space 66 may be defined either by the shape of the repositioner 34 as manufactured, or by deflection upon actual insertion of the shoulder strap 28. During use, the upper edge 29 of the shoulder strap 28 bears against the upper connecting web 64.

As thus far described, during use the lap belt 26 is held within the space 58, and upward movement of the repositioner 34 is restrained by engagement of the lower edge 27 of the lap belt 26 with the lower connecting web 56. At the same time, the shoulder strap 28 is held within the space 66, and deflection of the shoulder strap 28 is provided by engagement of the upper edge of the shoulder strap 28 with the upper connecting web 64.

In the event of a collision, it is desirable that the repositioner 34 release itself so as to allow the shoulder strap 28 to separate from the lap belt 26 and move to an optimum position of the diagonal shoulder strap 28 in order to protect the user in a manner consistent with the design function of the vehicle seat belt assembly 24.

In order to facilitate this result, an upper notch 70 is provided in the downwardly extending tongue 54 (the front tongue) near the upper connecting web 60, thus weakening the structure at that point. The notch 70 extends all the way across the repositioner 34. The upper notch 70 is formed in the inside surface of the front tongue 54, facing the space 66, and is accordingly hidden from view. However, functionally the upper notch 70 can be on the visible surface of the front tongue 54 corresponding to the repositioner front 48.

Likewise, there is a lower notch 72 in the upwardly extending tongue 52 (the rear tongue), near the lower connecting web 56 also extending all the way across, and weakening the structure at that point. The lower notch 72 is formed in the inside surface of the rear tongue 52, facing the space 58, and is accordingly hidden from view. However, functionally the lower notch 72 can be on the surface of the rear tongue 52 which corresponds to the repositioner rear 49.

In the event of a collision, one or the other of the tongues 52 or 54, most likely the downwardly extending (front) tongue 54, either breaks or bends away at its respective notch 70 or 72, and does so in a relatively controlled manner.

Figure 5:
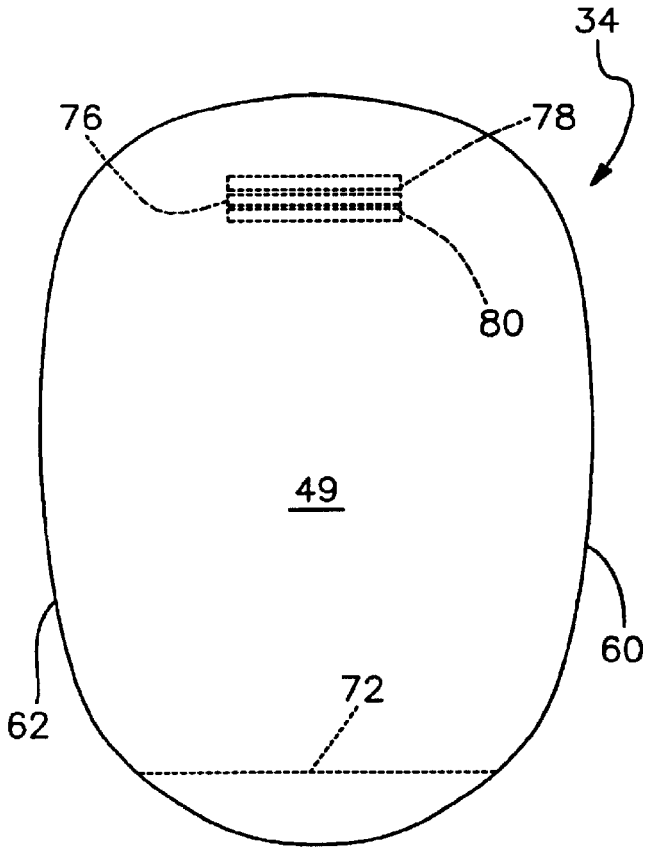
FIG. 5 is a rear view, taken on line 5—5 of FIG. 3.

In addition, and referring to FIG. 5 in addition to FIGS. 2 and 3, to aid in retention of the repositioner 54 to the lap belt 26, and additionally to provide an audible "click" sound when installed, at the upper end of the space 58 for the lap belt is a fastening device in the form of a click type latch device 74, comprising an element in the form of an inclined projection 76 on the upwardly extending (rear) tongue 52, and a mating element in the form of an inclined projection 78 on the intermediate portion 50. Another projection 80 on the upwardly extending (rear) tongue 52 backs up the mating inclined projection 78. The projections 76, 78 and 80 extend laterally a distance sufficient to serve the latching function. The click type latch device can be repeatedly engaged and disengaged, producing an audible "click" each time, and permitting the repositioner 54 to be repeatedly installed and uninstalled.

Figure 6:
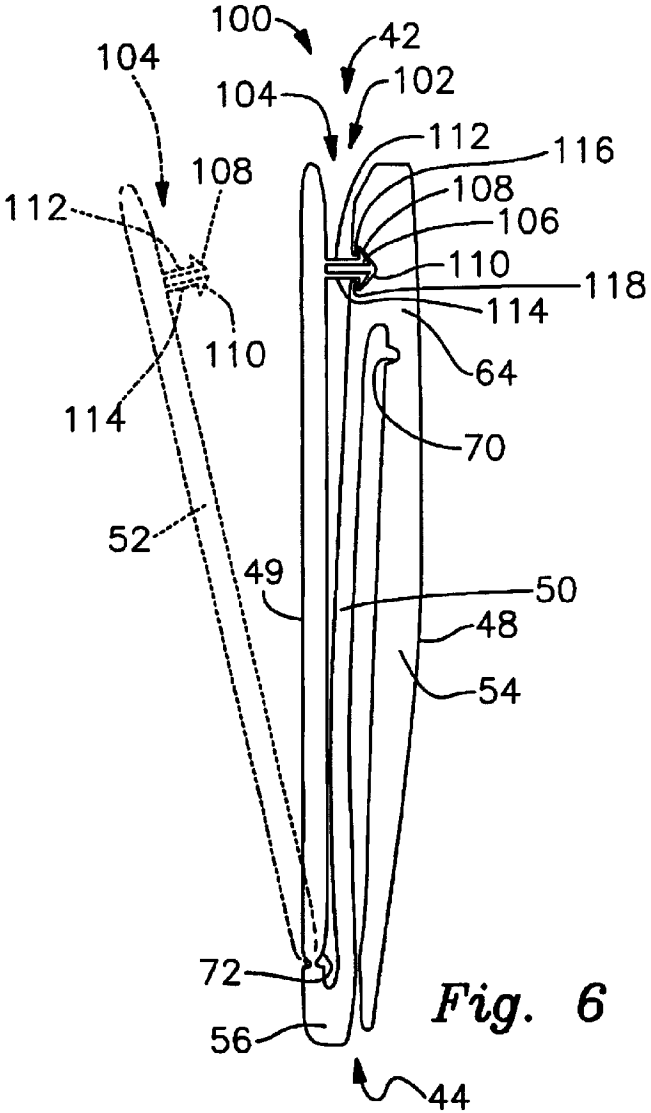
FIG. 6 is a left side elevational view of a second repositioner embodiment, generally in the same orientation as the cross-sectional view of FIG. 3.

FIG. 6 depicts a second repositioner 100 embodying the invention. In FIG. 6, the designated elements correspond where reference numbers identical to those described above with reference to the repositioner 34 are employed. In the second repositioner 100 embodiment of FIG. 6, the click latch 74 is replaced by a fastening device in the form of a retaining snap 102 which is not intended to be disengaged once engaged. Once engaged, the retaining snap 101 more or less permanently secures the upwardly extending tongue 52 (the rear tongue) and the intermediate portion 50 to each other at that point. Removal without damaging the repositioner 100 is difficult. Thus, the repositioner 100 can be permanently installed to the lap belt 26 of a particular vehicle.

The retaining snap 102 more particularly takes the form of a barbed, split locking device 104 integral with the upwardly extending tongue 52 (the rear tongue), and a mating receiver 106 integral with the intermediate portion 50. The locking device 104 includes a pair of teeth 108 and 110 at the ends of respective flexible stems 112 and 114. The receiver 106 includes a pair of inwardly-extending flanges 116 and 118 or ledges 116 and 118 positioned so as to be engaged by the teeth 108 and 110.

The locking device 104 and the mating aperture 106 may be either rectangular or circular. Thus, the locking device 104 may comprise a round pin 104. In that event, the separately-shown inwardly extending flanges 116 and 118 comprise portions of a circular flange.

In the embodiment of FIG. 6, the lower notch 72 also serves the function of a live hinge. Thus, the second repositioner embodiment 100 is manufactured and packaged in an open configuration shown in dash lines in FIG. 6 (in contrast to the closed position of the repositioner 34 embodiment depicted in FIG. 3). The live hinge 72 provides sufficient resiliency to allow the upwardly extending tongue 57 to be brought towards the intermediate portion 50, thereby capturing the lap belt 26 when the retaining snap 102 engages. The resultant locked closed configuration is shown in solid lines in FIG. 6.

Figure 7:
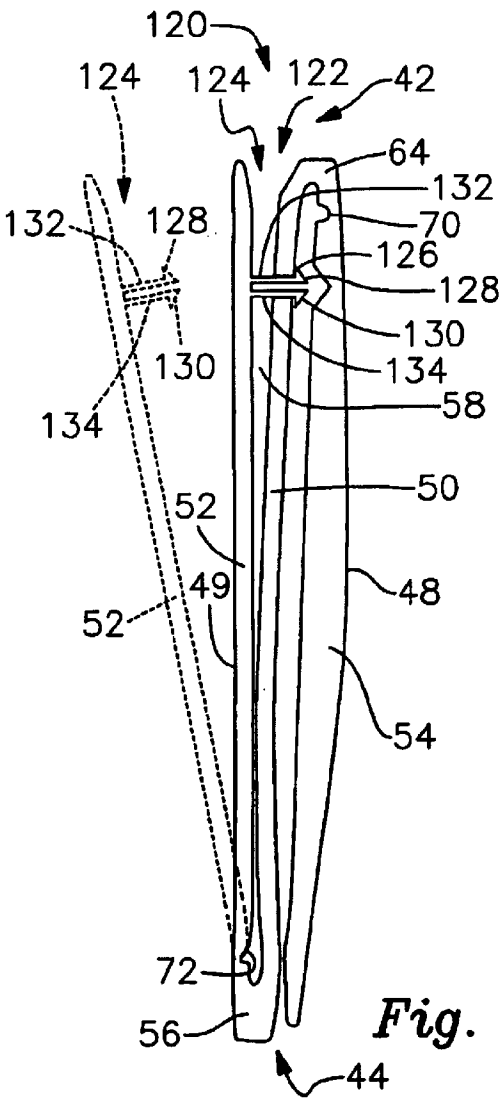
FIG. 7 is a left side elevational view of a third repositioner embodiment, generally in the same orientation as the cross-sectional view of FIG. 3.

Finally, FIG. 7 depicts a third repositioner 120 embodying the invention. In FIG. 7, as in FIG. 6, the designated elements correspond where reference numbers identical to those described above with reference to the repositioner 34 are employed. In the third repositioner 120 embodiment of FIG. 7, the click latch 74 also is replaced by a fastener device in the form of a retaining snap 122 which is not intended to be disengaged once engaged. Once engaged, the retaining snap 122 more or less permanently secures the upwardly extending tongue 52 (the rear tongue) and the intermediate portion 50 to each other at that point. Removal without damaging the repositioner 120 is difficult. Thus, the repositioner 120 can be permanently installed to the lap belt 26 of a particular vehicle.

The retaining snap 122 more particularly takes the form of a barbed, split locking device 114 which passes through an aperture 126 in the intermediate portion 50 in alignment with the upper notch 70 in the downwardly extending tongue 54 (the front tongue). The locking device 114 includes a pair of teeth 128 and 130 at the ends of respective flexible stems 132 and 134 integral with the upwardly extending tongue 52 (the rear tongue). The aperture 116 being in alignment with the upper notch facilitates clearance between the teeth 128 and 130 and the downwardly extending tongue 54 (the front tongue)

The locking device 124 and the corresponding aperture 126 may be either rectangular or circular. Thus, the locking device 124 may comprise a round pin 124.

In the embodiment 120 of FIG. 7 the lower notch 72 also serves the function of a live hinge, in the same manner as is described hereinabove with reference to FIG. 6. Thus, the third repositioner embodiment 120 is manufactured and packaged in an open configuration shown in dash lines in FIG. 7. The live hinge 72 provides sufficient resiliency to allow the upwardly extending tongue 52 to be brought towards the intermediate portion 50, thereby capturing the lap belt 26 when the retaining snap 122 engages. The resultant locked closed configuration is shown in solid lines in FIG. 7.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A shoulder strap repositioner for use in combination with a vehicle seat belt assembly having a lap belt and a diagonally-extending shoulder strap, said shoulder strap repositioner having a top, a bottom, a front and a rear, being generally "S" shaped in cross section, and comprising:

a generally flat panel-like intermediate portion;

a generally flat panel-like upwardly extending tongue at the rear of said repositioner attached at said repositioner bottom by a lower connecting web to said intermediate portion, defining a space for the lap belt between said upwardly extending tongue and said intermediate portion;

a generally flat panel-like downwardly extending tongue at the front of said repositioner attached at said repositioner top, by an upper connecting web to said intermediate portion, defining a space for the shoulder strap between said downwardly extending tongue and said intermediate portion; and either said downwardly extending tongue having an upper weakened portion extending laterally across said downwardly extending tongue near said upper connecting web, or said upwardly extending tongue having a lower weakened portion extending laterally across said upwardly extending tongue near said lower connecting web, or both, such that said repositioner releases itself in the event of a collision.

2. The repositioner of claim 1, wherein each of tire said weakened portions comprises a notch.

3. The repositioner of claim 1, which further comprises a fastening device at the upper end of the space for the lap belt including an element on said upwardly extending tongue and a mating element on said intermediate portion to aid in retention of the repositioner to the lap belt.

4. The repositioner of claim 3, wherein said elements of said fastening device can be repeatedly engaged and disengaged.

5. The repositioner of claim 3, wherein said fastening device is not intended to be disengaged once engaged.

6. The repositioner of claim 4, wherein said fastening device comprises a click type latch device.

7. The repositioner of claim 5, wherein said fastening device comprises a barbed, split locking device on said upwardly extending tongue.

8. The repositioner of claim 7, wherein said fastening device further comprises a mating receiver integral with said intermediate portion.

9. The repositioner of claim 7, wherein said fastening device further comprises an aperture in said intermediate portion through which aperture said barbed, split locking device passes.

10. The repositioner of claim 2, wherein said downwardly extending tongue has an upper weakened portion in the form of a notch extending laterally across said downwardly extending tongue, near said upper connecting web; and which repositioner further comprises a fastening device at the upper end of the space for the lap belt including an element on said upwardly extending tongue and a mating element on said intermediate portion to aid in retention of the repositioner to the lap belt, said fastening device including a barbed, split fastening device on said upwardly extending tongue and an aperture in said intermediate portion in alignment with said notch through which aperture said barbed, split locking device passes.

11. A shoulder strap repositioner for use in combination with a vehicle seat belt assembly having a lap belt and a diagonally-extending shoulder strap, said shoulder strap repositioner having a top, a bottom, a front and a rear, being generally "S" shaped in cross section, and comprising:

a generally flat nanel-like intermediate portion;

a generally flat panel-like upwardly extending tongue at the rear of said repositioner attached at said repositioner bottom by a lower connecting web to said intermediate portion, defining a space for the lap belt between said upwardly extending tongue and said intermediate portion;

a generally flat panel-like downwardly extending tongue at the front of said repositioner attached at said repositioner top, by an upper connecting web to said intermediate portion, defining a space for the shoulder strap between said downwardly extending tongue and said intermediate portion; and a fastening device at the upper end of the space for the lap belt including an element on said upwardly extending tongue and a mating element on said intermediate portion to aid in retention of the repositioner to the lap belt, said fastening device not being intended to be disengaged once engaged, and said fastening device comprising a barbed, split locking device on said upwardly extending tongue.

12. The repositioner of claim 11, wherein said fastening device further comprises a mating receiver integral with said intermediate portion.

13. The repositioner of claim 11, wherein said fastening device further comprises an aperture in said intermediate position through which aperture said barbed, split locking device passes.

14. The repositioner of claim 11, wherein said downwardly extending tongue has an upper weakened portion in the form of a notch extending laterally across said downwardly extending tongue near said upper connecting web; and wherein said fastener device further comprises an aperture in said intermediate portion in alignment with said notch and through which said barbed, split locking device passes.

* * * * *